United States Patent [19]

Rowland

[11] 3,975,083

[45] Aug. 17, 1976

[54] WIDE ANGLE RETROREFLECTOR ASSEMBLY AND METHOD OF MAKING SAME

[75] Inventor: William P. Rowland, Southington, Conn.

[73] Assignee: Reflexite Corporation, New Britain, Conn.

[22] Filed: July 24, 1974

[21] Appl. No.: 491,356

[52] U.S. Cl. ..... 350/103; 350/104

[51] Int. Cl.[2] ..... G02B 5/12

[58] Field of Search ..... 350/102, 103, 104, 105, 350/106, 109, 320

[56] References Cited

UNITED STATES PATENTS

| | | | |
|---|---|---|---|
| 3,140,340 | 7/1964 | Weber | 350/103 |
| 3,684,348 | 8/1972 | Rowland | 350/103 |
| 3,836,226 | 9/1974 | Cechetini | 350/103 |

FOREIGN PATENTS OR APPLICATIONS

| | | | |
|---|---|---|---|
| 518,963 | 9/1957 | Italy | 350/106 |
| 441,319 | 7/1936 | United Kingdom | 350/103 |
| 804,929 | 3/1958 | United Kingdom | 350/104 |

*Primary Examiner*—John K. Corbin
*Assistant Examiner*—Richard A. Rosenberger

[57] ABSTRACT

A retroreflective assembly is provided by a base having closely spaced retroreflective formations in its upper surface portion and a top member having closely spaced prism formations of the lower surface thereof and light directing formations on the upper surface thereof. Light rays impinging upon the assembly at an angle of less than 10 degrees are directed into the body of the top member by the light directing formations and pass into the prism formations which in turn direct light rays into the retroreflective formations of the base member. The retroreflective formations then retroreflective the light rays back into the prism formations and the light rays pass into the light directing formations on the upper surface and back towards the source. The composite structure is readily fabricated from synthetic plastic materials in its entirety or with glass bead retroreflective elements and can be sealed to provide a highly useful lane dividing strip for roadways and the like.

14 Claims, 7 Drawing Figures

WIDE ANGLE RETROREFLECTOR ASSEMBLY AND METHOD OF MAKING SAME

BACKGROUND OF THE INVENTION

There has been a considerable desire to utilize materials for delineating traffic lanes on highways and the like which would retroreflect light rays impinging thereon so as to provide maximum visibility. To this end glass retroreflective beads have been incorporated in coating materials utilized to paint line delineating markings and plastic strips having retroreflective properties have also been employed. There has also been a significant amount of efforts to utilize retroreflective cannisters and other structures which would project above the surface of the roadway, all of which have proven useful but limited in their degree of acceptance.

One of the major criteria for such roadway materials is that the upper surface thereof be able to withstand the considerable abrasion and impact that occurs during use. Embedding the materials in the surface of the roadway tends to reduce their effectivenss since the light rays impinging thereon from the headlights will in large measure be at an angle to the roadway surface of about 1 to 15°. As a result, retroreflective formations disposed at the level of the top surface or therebelow will generally be inefficient since the angle of incidence is so small relative to the plane of the retroreflector strip.

Minnesota Mining and Manufacturing Company has long sold material under the trademark SCOTCHLITE which relies upon minute glass spheres embedded in a matrix of synthetic resin to provide such retroreflection and materials of this type have been used as highway type markers as well as in signs and other applications. Molded cube corner retroreflectors have long been known as evidenced by Straubel U.S. Pat. No. 835,648 granted Nov. 13, 1906; Hedgewick et al U.S. Pat. No. 3,258,840 granted July 5, 1966; and Jungersen U.S. Pat. Nos. 2,310,790 granted Feb. 9, 1943 and No. 2,444,533 granted July 6, 1948.

Recently it has been proposed to manufacture retroreflective materials employing minute cube corner formations cast upon one surface of a preformed body member as is fully described in Rowland United States Letters Patent No. 3,684,348 granted Aug. 15, 1972. In an effort to accommodate the problems of utilizing such retroreflective materials in roadways, Applicant has proposed a cannister assembly having a prism element for directing the light onto the surface of a retroreflective element sealed within the body of the cannister as is fully described in Applicant's copending United States Application Ser. No. 358,174 filed May 7, 1973. Obviously such cannister assemblies require greater installation time and expense than would flexible sheet material which could adhere either upon the surface or within shallow grooves formed in the surface of the roadway.

It is an object of the present invention to provide a novel retroreflective assembly which is capable of retroreflecting light rays impinging thereon at an angle of 10° or less.

It is also an object to provide such a retroreflective assembly which is relatively resistant to abrasion and which is substantially self-cleaning.

Another object is to provide such a retroreflective assembly which may be produced relatively easy and relatively economically substantially entirely from synthetic resins.

Still another object is to provide a novel method for producing a highly effective retroreflective assembly for use in roadways and the like, which method is relatively simple and relatively economical.

SUMMARY OF THE INVENTION

It has been found that the foregoing and related objects can be readily obtained by a retroreflective assembly comprising a base having closely spaced retroreflective formations in its upper surface portion and a top member having closely spaced prism formations on the lower surface thereof of a size providing a center-to-center spacing at least a factor of 3 relative to the center-to-center spacing of the retroreflective formations of the base. The top member has light directing formations on the top surface thereof directing light rays impinging thereon at an angle of less than 10° to the longitudinal plane of the assembly downwardly into the prism formations thereof. The prism formations direct the light rays into the retroreflective formations of the base, which in turn retroreflect the light rays back into the prism formations. The prism formations of the top member and the light directing formations then redirect the retroreflected light rays in the direction from which originally received.

In accordance with the preferred embodiments of the invention, the center-to-center spacing factor is at least 8 and the center-to-center spacing of the prism formations of the top member is larger than the center-to-center spacing of the retroreflective formations. To improve efficiency and reduce size, the prism formations are truncated.

The retroreflective formations of the base may conveniently be cube corner in configuration and provided by cube corner configured elements disposed upon the lower surface of a top section of the base with the apices thereof spaced from the top member. Alternatively, the retroreflective formations may be retroreflective spherical elements.

The light directing formations are conveniently ribs extending transversely of the longitudinal axis of the assembly, conveniently of isoceles triangular cross section with base included angles of 3°–10°.

The base and top members are fabricated from synthetic resin and are sealed together at least along their side margins and most desirably are additionally sealed transversely at spaced points along the longitudinal axis thereof so as to provide a multiplicity of closed cells along the length thereof. To provide convenient means for mounting the retroreflective assembly upon a roadway or the like, the assembly additionally includes an adhesive coating on the lower surface of the base, and release sheet material covering the adhesive coating and removable therefrom.

In making the retroreflective assembly, the method includes the step of forming a base having closely spaced retroreflective formations in its upper surface portion configured to retroreflect light rays impinging on the upper surface thereof. A top member is formed with closely spaced prism formations on one surface thereof dimensioned to provide center-to-center spacing at least a factor of 3 relative to the center-to-center spacing of the retroreflective formations of the base and with light directing formations on the top surface thereof dimensioned and configured to direct light rays impinging thereon at an angle of less than 10° to the longitudinal axis of the top member downwardly into the prism formations thereof. The top member is assembled to the base with the prism formations adjacent the top surface of the base, and the base and top member are sealed together at least along the side margins thereof to provide a substantially sealed structure.

As indicated hereinbefore, most desirably the base and top member are sealed at a multiplicity of transverse points to provide closed cells along the length thereof. The base member is most conveniently provided by initially forming a first member which is transparent and which has a multiplicity of cube corner formations upon one surface thereof. This first member is then assembled to a substrate member with the cube corner formations disposed adjacent the substrate member. To provide a selfcontained assembly for use upon roadways and the like, the method desirably includes the additional step of providing an adhesive coating on the lower surface of the base and a covering of release sheet material over the adhesive.

DETAILED DESCRIPTION OF THE ILLUSTRATED EMBODIMENT

Figure 1:
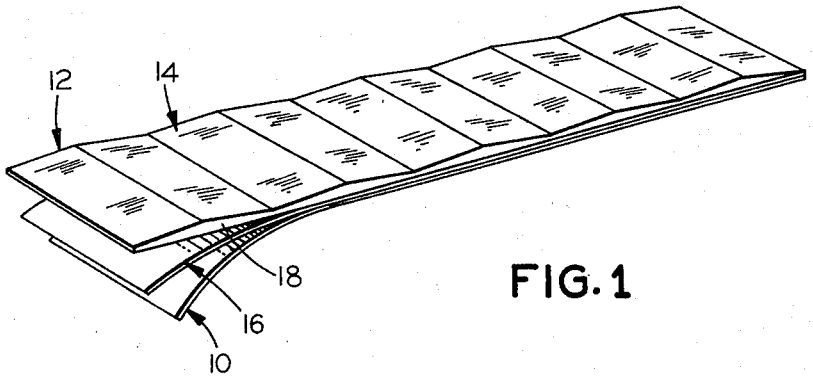
FIG. 1 is a perspective view of a retroreflective assembly embodying the invention with some component elements exaggerated as to thickness and partially delaminated adjacent one end thereof for purposes of ilustration.
Figure 2:
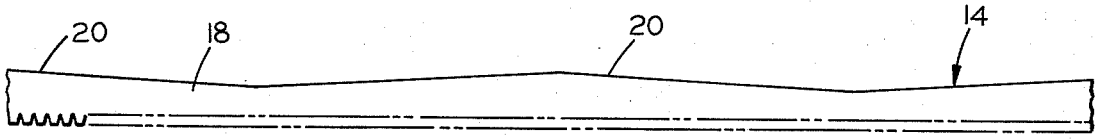
FIG. 2 is a fragmentary side elevational view to an enlarged scale of the top member subassembly of the retroreflective assembly of FIG. 1.
Figure 3:
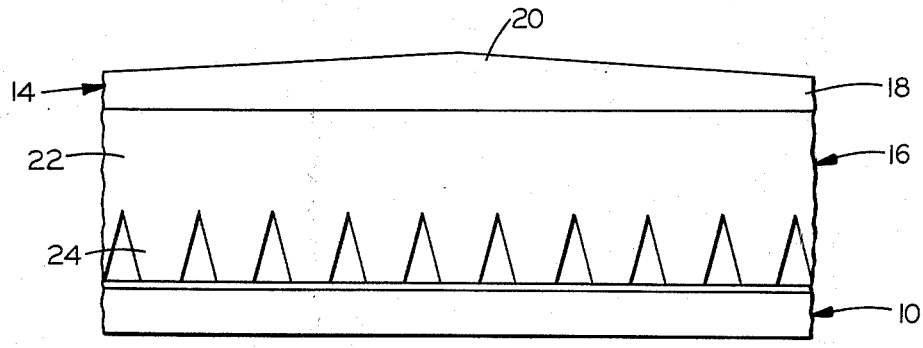
FIG. 3 is a fragmentary cross sectional view to a greatly enlarged scale of the retroreflective assembly of FIG. 1.

Turning now to FIGS. 1–4 of the attached drawings in detail, a retroreflective assembly embodying the present invention is illustrated in somewhat exaggerated fashion as comprised of a base member generally designated by the numeral 10 and a top member generally designated by the numeral 12 and comprised of the shallow prism top sheet generally designated by the numeral 14 and steep prism sheet generally designated by the numeral 16. In the assembled condition, the top sheet 14 and prism sheet 16 are bonded together through their area of surface contact, and the subassembly provided thereby is bonded to the base sheet 10 at least along the longitudinal side margins and at spaced points (not shown) transversely along the length thereof to provide a multiplicity of closed cells which are substantially weathertight.

As can be seen in FIGS. 1–4, the top sheet 14 includes a body portion 18 and provides a multiplicity of closely spaced shallow ribs 20 of triangular cross section extending transversely on the retroreflective assembly. Similarly, the prism sheet 16 is comprised of a body portion 22 and a multiplicity of truncated prisms 24 which also extend transversely of the length of sheet material. Both the prism sheet 16 and the top sheet 14 are transparent and substantially free from any particulate matter so as to avoid interference with the transmission of light rays therethrough.

Figure 4:
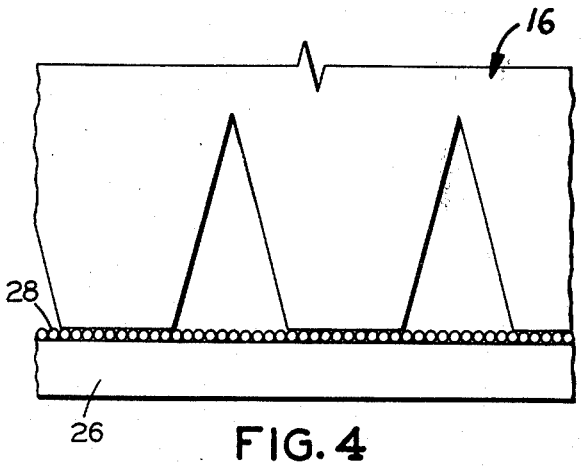
FIG. 4 is a fragmentary cross sectional view to a still further enlarged scale showing one type of retroreflective formations employed in the base.

In the embodiment of FIG. 4 the base sheet 10 is comprised of a body portion 26 and a multiplicity of minute glass spheres 28 which are designed to retroreflect light rays entering thereinto. Further details on the construction of this type of retroreflective sheet material, which is widely sold under the trademark SCOTCHLITE by Minnesota Mining and Manufacturing Company, can be found in Fisher et al United States Letters Patent 2,592,882 granted Apr. 15, 1951; Hodgson United States Letters Patent 2,948,191 granted Aug. 9, 1960; and McKenzie United States Letters Patent 3,190,178 granted June 22, 1965.

Figure 5:
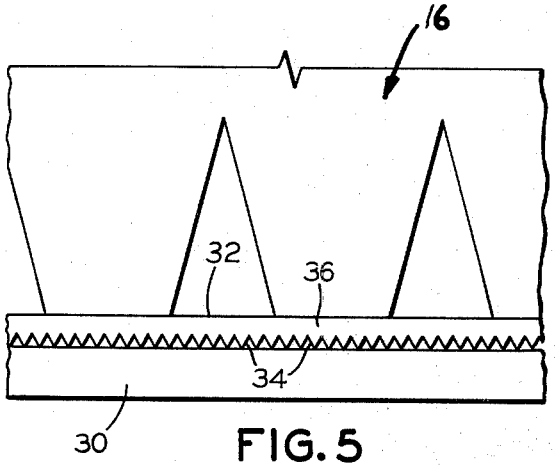
FIG. 5 is a similar view showing another embodiment of retroreflective formations in the base.

In the embodiment of FIG. 5, the base sheet 10 is comprised of a body portion 30 and a cube corner sheet 32, the latter having minute cube corner formations 34 projecting from the lower surface of the web 36. Details concerning the manufacture and structure of this particular embodiment of retroreflective sheet material may be found in United States Letters Patent No. 3,684,348 granted Aug. 15, 1972.

Figure 7:
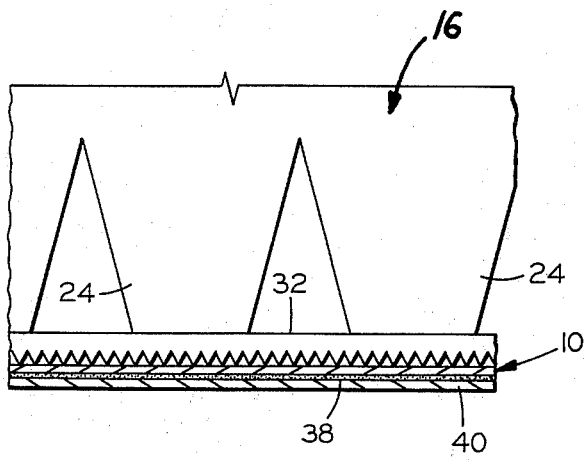
FIG. 7 is a partially exploded cross sectional view of the embodiment of FIG. 5 additionally including an adhesive layer and a release coating.

FIG. 7 illustrates a preferred retroreflective assembly which may be mounted easily or quickly upon a roadway or similar surface. In this particular embodiment, a layer of adhesive 38 is applied to the lower surface of the base member 10 and release paper 40 is applied thereover.

Figure 6:
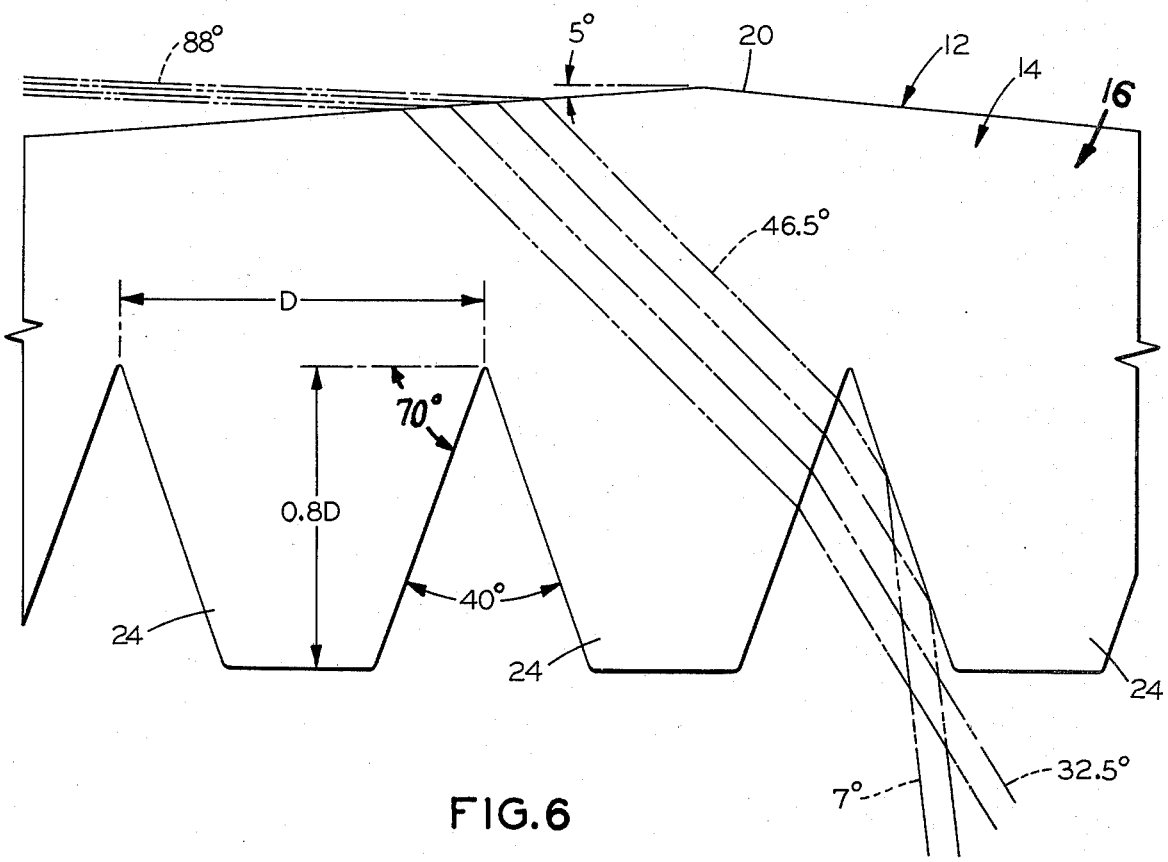
FIG. 6 is a diagrammatic view of the top member showing dimensional and angular relationships of the light directing ribs and prisms.

In FIG. 6 there is illustrated a preferred embodiment of the top member 12 which includes dimensional and angular interrelationships. As can be seen, the top sheet 14 has shallow ribs 20 dimensioned and configured to provide a cross section approximating an isoceles triangle having base included angles of 5°. The prism sheet 16 is formed with truncated prisms 24 having a base width D and base angles of 70°. The prisms are truncated at a point providing a height of 0.8 D. This top member 12 may be used with either of the embodiments of base member 10 shown in FIGS. 4 and 5. Preferably D is selected so as to be 8 to 15 times larger than the center-to-center spacing of the retroreflective formations of the base member 10.

As can be seen, light from the headlights of a vehicle strikes the shallow ribs 20 at an angle of about 88° to the vertical or about 2° to the horizontal. The ribs 20 direct the light rays impinging thereon at an angle of about 46.5° to the vertical as a result of a refraction of 41.5°. The 20° angular orientation of the sides of the prisms 24 causes the light rays passing outwardly therefrom to have an angular orientation of about 32.5° relative to the vertical, but some of these light rays are reflected from the side surfaces of adjacent prisms 24 to an angle of about 7° to the vertical.

The light rays passing from the prisms 24 are thus directed into the retroreflective formations of the base member 10 and these formations produce substantial retroreflection of the light rays impinging thereon. The light rays emitted therefrom then pass back into the prisms 24 and upwardly through the top member 12 to the side surface of the lenticular ribs 20. As they exit from the top surface of the top member 12, they return in substantially a parallel path towards the vehicle from which they came.

As will be appreciated, the shallower the included angle of the light rays striking the top surface of the retroreflective assembly, the more light will be reflected from the surface rather than entering into the body of the retroreflective assembly. Conversely, the greater the included angle, the smaller the angle of refraction of the light rays entering into the body of the retroreflective assembly. Thus there is a necessity for balancing the desirability of increasing the amount of light rays entering into the body of the structure with minimization of the decrease in vertical angle from refraction since the light rays must pass downwardly through the top member into the retroreflective formations of the base member. Assuming that the retroreflective assembly is disposed either upon the top surface of the roadway or within a shallow groove formed in the top surface of the roadway, light rays from automobile headlights will normally be impinging upon the road surface at an included angle to the horizontal of 0° to 5°. According to Fresnel's Laws, the effect of angle of incidence upon angle of refraction, deviation, and reflection is as follows:

$$\frac{I\ \text{Reflected}}{I\ \text{Original}} = \tfrac{1}{2}\ \frac{\sin^2(i-r)}{\sin^2(180-(i+r))} + \tfrac{1}{2}\ \frac{\tan^2(i-r)}{\tan^2(180-(i+r))}$$

As has been indicated hereinbefore, the present invention utilizes transparent synthetic resins for fabrication of the various components except where glass beads provide the retroreflective elements. Assuming that the synthetic resin of the top member has a refractive index of 1.49, the following tabulation sets forth the effect of angle of incidence upon angle of refraction, deviation, and reflection:

| Angle Incidence (∢) | Angle Refracted (r) | Deviation (d) | % Reflected (Single Pass) | % Returned (Double Pass) |
|---|---|---|---|---|
| 84 | 41.87 | 42.12 | 55 | 20 |
| 85 | 41.95 | 43.04 | 61 | 15 |
| 86 | 42.02 | 43.9 | 67 | 11 |
| 87 | 42.08 | 44.9 | 74 | 6.8 |
| 88 | 42.1 | 45.87 | 82 | 3.2 |
| 89 | 42.14 | 46.85 | 90 | 1 |
| 90 | 42.16 | 47.8 | 100 | 0 |

The angle of incidence of the light rays striking the road surface from the headlights of an automobile is shallow relative to the horizontal (or steep relative to the vertical depending upon the frame of reference which one chooses to employ). For example, a headlamp 33 inches above the road surface will produce light rays which strike the road surface at an angle of 2° to the roadway surface 78.79 feet ahead, 1.5° at 104.96 feet ahead and 1° at 157.14 feet ahead. If the headlamp is 30 inches above the road surface, the light rays will strike the roadway surface at an angle of 2° at a distance of 71.63 feet ahead, 1.5° at 95.41 feet ahead and 1° at 142 feet ahead.

From the above tabulation it can be seen that a light ray impinging upon a retroreflector without the shallow prisms 20 at an angle of 1° to the horizontal will be reflected 90 percent and refracted into the body of the assembly only 10 percent. When the light ray is retroreflected back to the top surface, the same percentage loss will occur with 90 per cent being reflected back into the body of the assembly and only 10 per cent being refracted into air towards the vehicle from which the light rays came. Thus, only 1 per cent of the light impinging upon the structure is theoretically available for retroreflection to the vehicle. Increasing the angle of incidence to 4° from the horizontal reduces the amount reflected to 67 per cent and provides about 11 per cent retroreflection of the light striking the assembly; however, at the same time the light rays are being directed downwardly at a shallower angle which will tend to reduce the internal efficiency of the assembly. By providing the shallow prisms 20 on the top surface, the light rays will thus strike at an angle of incidence increased by the angle of the shallow prism, e.g., 6° for a prism having an angle of 5° and a light ray impinging at an angle to the horizontal plane of the retroreflector of 1°, providing 20% retroreflection.

As will be appreciated, the area of the shallow ribs which provides the principal refraction of light rays into the body of the assembly is the portion adjacent the apices or crowns. The area closely adjacent the body of the assembly, i.e., the valleys, is generally in shadow due to the shallow angle of incidence of light rays falling thereon. Although other shapes of light redirecting ribs may be employed including cylindrical and parabolic, the triangular cross section of the illustrated embodiment is most efficient. Similarly, the shallow ribs need not be continuous across the full width of the structure and may comprise discrete lens-like embossments of spheroidal and cube corner configuration configured and dimensioned to provide the desired angle of incidence. However, for most applications, the retroreflective assembly will be intended to function in one direction principally or in two directions spaced 180° apart. Use of discrete lens-like embossments will minimize the efficiency from the standpoint of a unidirectional or bidirectional structure because of the lesser surface area available for refraction of light into the body of the assembly.

Thus a variety of configurations are available for the shallow ribs to facilitate refraction of light rays into the body of the retroreflective assembly, the key factor being a configuration and dimensioning for the upper portions or crowns of the shallow ribs which will provide the desired level of refraction. The illustrated triangular rib extending continuously transversely of the sheet has been found most efficient for this purpose and is preferably disposed on a perpendicular axis to the body of the sheet material when intended for bidirectional application. As will be appreciated, the triangular cross section may be skewed for unidirectional applications, and the valleys may be rounded rather than sharply angular as illustrated. Using such a triangular cross section, a base included angle of 2° to 15° and preferably about 3° to 8° has been found quite effective. To minimize the thickness of the assembly required to provide the shallow ribs, these are spaced apart center-to-center ¼ to 3 inches and preferably about ½ to 1 inch.

Turning now to the dimensioning and configuration of the prism elements on the lower surface of the top member, the included angle is one which is selected so as to balance the effective area of the prism lost due to its blind spot with the loss of retroreflecting efficiency occurring due to increase in the angle of incidence of the light rays directed by the prisms into the retroreflective formations of the base member. It will be appreciated that there is a blind spot in the prism formations determined by the angle of light passage thereinto. The steeper the angle of refraction into the prisms, the less the area of the blind part. The tips of the prisms are substantially ineffective for purposes of directing the light rays onto the retroreflective formations and therefore removal of the ineffective tip portions of an other otherwise triangular prism is highly advantageous in permitting reduction in total thickness of the structure and in minimizing shadow and other undesired effects. The truncated prisms of the illustrated embodiment have proven most advantageous although full prism elements can be employed if desired. Since the effective area of the prisms includes the portion adjacent their junctures, these elements should be closely spaced with angles as sharply defined as possible.

The effect of changing the included angle of the prism elements is significant since reduction in the included angle will increase the steepness of the angle at which light is refracted onto the retroreflective formations, but the blind area is increased thus reducing the amount of refracting surface available. Using a synthetic resin with a refractive index of 1.5, the following values may be calculated:

| Included Angle | Angle of Refraction |
|---|---|
| 40 | 24.8 |
| 50 | 28.8 |
| 60 | 32 |

In view of these factors, it is desirable to select the included angle for the prism elements based upon the nature of the retroreflective formations. The intensity of retroreflection in a glass bead retroreflector varies inversely with angle of incidence substantially linearly in a relatively shallow slope. However, in a cube corner retroreflector, there is a sharp curve wherein intensity drops rapidly at an angle of incidence above 20°. Thus it is most critical to select a configuration to produce angles of incidence of less than about 25° when employing cube corner retroreflectors since this will provide intensity levels in excess of those obtainable with glass bead retroreflectors. Based upon a synthetic resin having a refractive index of 1.5, the included angle of the prism is within the range of 30°–50° and preferably 35°–45° for cube corner retroreflectors, and it is within the range of 45°–75° and preferably 55°–65° when using glass bead retroreflectors. These values will obviously change depending upon the refractive index of the synthetic resin employed.

In practice, included angles of 35° to 75° and preferably 40° to 60° may be used depending upon the index of refraction of the material and the particular retroreflective formations employed to obtain optimum results. The prisms preferably selected so as to be relatively large compared with the retroreflective elements and to permit formation with a high degree of precision with spacing on centers of 0.01–0.3 inch and preferably 0.02–0.1 inch. The amount of the prism which is removed to provide the truncated structure for the preferred embodiments is best determined after precalculation of the angles of incidence and reflection and the blind spot or area of the prism. Generally, however, the prisms will be truncated at a height of about 0.7–0.9 times the width of the base.

Turning now to the retroreflective elements, as has been previously indicated, these may be of either the glass bead or cube corner type. Various types of the glass bead retroreflective sheet may be employed including those having flat resin top surfaces or exposed beads. Similarly, the cube corner retroreflectors may be the conventionaL molded structures of the Stimsonite type or the composite synthetic resin structures of the aforementioned Rowland United States Letter Patent 3,684,348 granted Aug. 15, 1972. As has been indicated hereinbefore, there should be a significant dimensional difference between the center-to-center spacing of the retroreflective formations and the center-to-center spacing of the prism elements of the top member. Generally the dimensional difference will be a factor of at least 3 and up to 50 and preferably 8 to 20. Although either element may be the larger in dimension it is generally most convenient to have the prism formations as the larger of the two. Using the retroreflective formations as the smaller from the standpoint of the spacing factor described above, glass bead sheeting using spheres of 0.001–0.010 inch diameter has proven quite effective, and composite plastic cube corner sheeting of the aforementioned Rowland Patent having a spacing on centers for the cube corners of 0.002–0.020 inch has been superior for many applications because of the higher brilliance at lower angles of incidence.

The resins from which the top and bottom members are formed are preferably selected so as to provide temperature resistance, weatherability, moisture resistance and abrasion resistance. It will be appreciated that different resins may be employed for the component parts of the retroreflective assembly so as to provide optimum properties as to each component part, but differences in indices of refraction in components of the top member should be closely evaluated to avoid undesired refraction at the interface. Among the resins which may be employed are polyol cured aliphatic polyurethanes, polyvinyl chloride plasticized to a high degree of flexibility, polycarbonates and modified polyacrylates, since these resins will provide a tough, resilient, scratch resistant and weather resistant surface to withstand traffic conditions. The base member may also be used in these resins and, in addition, other resins may be employed since the top member will provide some shielding from abrasion and impact.

As has been indicated hereinbefore, a self-contained structure for fascile installation in a roadway is conveniently provided by applying a layer of adhesive to the lower surface of the base member and then covering this adhesive coating with release paper or film. Various types of adhesives may be employed depending upon the synthetic resin of the base member and the desired properties including range of temperatures anticipated during use.

Although the top member has been illustrated and described as being fabricated from two separate strips of material independently embossed or cast to provide respectively the lenticular ribs and prism formations, it will be appreciated that both types of formations may be embossed or cast in a single thickness of material to provide an integral top member. However, convenient and precision formation favors separate embossment or casting and adhesive bonding of the two layers into a subassembly.

It is essential that the top and bottom members be bonded thoroughly to each other to provide a durable structure. The truncated prism configuration has proven useful not only in reducing the thickness but also in providing the desired spacing and means for maintaining horizontal orientation of the two subassemblies. The top and bottom members should be adhesively bonded at least along their side margins and at their ends, and preferably at spaced points transversely along the length thereof so as to provide a multiplicity of closed cells. In the event that the integrity of the assembly is broken at any one point so as to allow entry of water, dirt or other contamination, the remaining cells will remain uneffected and continue to function. Adhesion of the two components may be by separate adhesive application, solvent sealing, heat sealing or any other suitable technique.

Illustrative of the present invention are the following specific examples:

EXAMPLE ONE

A retroreflective assembly is prepared substantially in accordance with FIG. 4 of the attached drawings utilizing conventional glass bead retroreflective sheeting of the type sold by Minnesota Mining and Manufacturing Company under the trademark SCOTCHLITE. The top member is formed from a modified polyurethane resin sheet having shallow ribs of shallow triangular cross section with base included angles of 10° and a spacing on center of about 0.75 inch. To this top sheet is assembled another sheet formed with truncated prisms having an included angle of 40° and a center-to-center spacing of about 0.030 inch with the prisms truncated at a height of 0.024 inch. The top member is adhesively bonded to the base member not only along the side margins thereof but transversely at intervals of about 1 inch to provide closed cells.

If a light beam is directed at an angle of 1° to the horizontal providing an angle of 89° to the vertical, 35.33 per cent of the impinging light is calculated to be reflected and 64.6 per cent of the light is calculated to be refracted into the body of the structure. The light is refracted to an angle of 51° relative to the vertical and is then refracted by the prisms to 42.5° relative to the vertical. Estimating 50 per cent efficiency for the retroreflector calculates to a loss of only 78 per cent of the incident light rays.

Observation of the brilliance of the retroreflective assembly in a test employing a high collimated light beam establishes brilliant retroreflection through a range of 1°–10° angular disposition of the light beam relative to the horizontal surface upon which the assembly is disposed.

EXAMPLE TWO

A similar assembly is prepared using shallow ribs having a base included angle of only 5° thus producing an angle of incidence for a 1° light ray of 84°. Calculations indicate a 50 per cent refraction of the incident light rays to an angle of 46.7° relative to the vertical in the top member and then to 35° relative to the vertical by the prisms. At this angle of incidence, the retroreflective formations are calculated and assumed to be 75 per cent effective so that the loss is 85 per cent.

A similar light test establishes brilliant retroreflection through the range of 1°–10° angular orientation of the collimated light beam relative to the horizontal.

Thus, it can be seen from the foregoing detailed specification and examples that the present invention provides a highly effective retroreflective assembly which is operative to provide a relatively high degree of brilliance and retroreflection with light rays which impinge upon the surface thereof at an angle which is relatively shallow. Such assemblies are particularly useful for marking roadway lanes and the like and may be fabricated from materials affording a high degree of wear resistance, weather resistance and impact resistance. Moreover, the exposed surfaces are substantially self-cleaning under traffic action so as to maintain a high degree of operability over an extended period of time. The assembly may be fabricated readily and relatively economically from several separately formed component elements permitting a high degree of precision, and it may be mounted readily upon a roadway surface or in a groove formed in the roadway surface.

Having described the invention, I claim:

1. An elongated retroreflective strip comprising:

a. an elongated base of sheet material having closely spaced retroreflective formations in its upper surface portion;

b. an elongated top member of sheet material having closed spaced prism formations on the lower surface thereof of a size providing a center-to-center spacing of about 0.01–0.3 inch and providing a center-to-center spacing at least a factor of 3 relative to the center-to-center spacing of said retroreflective formations of said base, said prism formations being of inverted generally triangular configuration and extending transversely of the longitudinal axis of said top member, said prism formations having their bases lying in substantially a common plane, said top member having a multiplicity of light directing formations spaced along the length of the top surface thereof directing light rays impinging thereon at an angle of less than 10° to the longitudinal plane of said strip downwardly into said prism formations thereof and said prism formations directing light rays into said retroreflective formations, said light directing formations having a center-to-center spacing of ¼ inch to 3 inches and comprising ribs extending transversely of the longitudinal axis of said top member, said base and top members being fabricated from elongated strips of synthetic resin sheet material sealed together at least along their side margins, said retroreflective formations of said base retroreflecting the light rays directed thereinto back into said prism formations, said prism formations of said top member and said light directing formations then redirecting retroreflected light rays in the direction from which originally received.

2. The retroreflective strip in accordance with claim 1 wherein said center-to-center spacing factor is at least 8.

3. The retroreflective strip in accordance with claim 1 wherein said center-to-center spacing of said prism formations is larger than the center-to-center spacing of said retroreflective formations.

4. The retroreflective strip in accordance with claim 1 wherein said prism formations are truncated.

5. The retroreflective strip in accordance with claim 1 wherein said retroreflective formations are cube corner in configuration and disposed upon the lower surface of a top section of said base with the apices thereof spaced from said top member.

6. The retroreflective strip in accordance with claim 1 wherein said ribs are of isosceles triangular cross section with base included angles of 3°–20°.

7. The retroreflective strip in accordance with claim 1 wherein said base and top members are additionally sealed transversely at spaced points along the longitudinal axis thereof.

8. The retroreflective strip in accordance with claim 1 wherein said retroreflective strip additionally includes an adhesive coating on the lower surface of said base and release sheet material covering said adhesive coating and removable therefrom.

9. The retroreflective strip in accordance with claim 1 wherein said retroreflective formations are spherical glass beads with said prism formations disposed thereupon.

10. In the method of making a retroreflective strip, the steps comprising:

a. forming a base of elongated sheet material having closely spaced retroreflective formations in its upper surface portion configured to retroreflect light rays impinging on the upper surface thereof;

b. forming a top member of elongated sheet material with closely spaced prism formations on one surface thereof dimensioned to provide center-to-center spacing at least a factor of three relative to the center-to-center spacing of said retroreflective formations of said base and with a multiplicity of light directing formations spaced along the length of the top surface thereof dimensioned and configured to direct light rays impinging thereon at an angle of less than 10° to the longitudinal axis of the top member downwardly into said prism formations thereof, said prism formations providing a center-to-center spacing of about 0.01–0.3 inch and said light directing formations having a center-to-center spacing of ¼ inch to 3 inches, said prism formations and light directing formations being ribs extending transversely on the longitudinal axis of said top member and said light directing formations being of inverted generally triangular configuration and having their bases lying in substantially a common plane;

c. assembling said top member to said base with said prism formations adjacent the top surface of said base; and d. sealing said base and top member at least along the side margins thereof to provide a substantially sealed elongated strip.

11. The method in accordance with claim 10 wherein said base and top member are sealed at a multiplicity of points transversely thereof to provide closed cells.

12. The method in accordance with claim 10 wherein said base member is formed by initially forming a first member which is transparent and has a multiplicity of cube corner formations upon one surface thereof and assembling said first member to a substrate member with the cube corner formations adjacent said substrate member.

13. The method in accordance with claim 10 wherein there is included the additional step of providing an adhesive coating on the lower surface of said base and a covering of release sheet material over said adhesive.

14. The method in accordance with claim 10 wherein said base member is formed by initially forming a first member which has a multiplicity of spherical reflective glass beads on one surface thereof and assembling said first member to a substrate member with the glass beads spaced from said substrate member.

* * * * *

UNITED STATES PATENT AND TRADEMARK OFFICE

CERTIFICATE OF CORRECTION

PATENT NO. : 3,975,083

DATED : August 17, 1976

INVENTOR(S) : William P. Rowland

It is certified that error appears in the above-identified patent and that said Letters Patent are hereby corrected as shown below:

Column 10, line 30, "closed" should be -- closely --;

Column 11, line 8, "3°-20°" should be -- 3°-10° --;

Column 12, line 6, "transversely on" should be -- transversely of --.

Signed and Sealed this

Eighth Day of February 1977

[SEAL]

*Attest:*

RUTH C. MASON
*Attesting Officer*

C. MARSHALL DANN
*Commissioner of Patents and Trademarks*